US006094746A

United States Patent [19]

Miller

[11] Patent Number: 6,094,746

[45] Date of Patent: Aug. 1, 2000

[54] NECKTIE KNOT COVER AND RETAINING DEVICE

[76] Inventor: Scott H. Miller, 4500 NW. 28th Ave., Boca Raton, Fla. 33434

[21] Appl. No.: 09/245,586

[22] Filed: Feb. 8, 1999

Related U.S. Application Data

[60] Provisional application No. 60/093,664, Jul. 22, 1998.

[51] Int. Cl.[7] ..... A41D 25/08

[52] U.S. Cl. ..... 2/152.1; 2/138; 2/148

[58] Field of Search ..... 2/137, 138, 144–145, 2/147–149, 152.1, 150, 153

[56] References Cited

U.S. PATENT DOCUMENTS

| | | | |
|---|---|---|---|
| 2,316,002 | 4/1943 | Koivisto | 2/144 |
| 3,999,222 | 12/1976 | Walborn | 2/150 |
| 5,010,593 | 4/1991 | Stevens | 2/152.1 |
| 5,035,002 | 7/1991 | Knight | 2/152.1 |
| 5,416,926 | 5/1995 | Koy | 2/153 |
| 5,493,731 | 2/1996 | Amnott | 2/148 |
| 5,920,907 | 7/1999 | Pierce | 2/152.1 |

*Primary Examiner*—John J. Calvert
*Assistant Examiner*—Tejash Patel
*Attorney, Agent, or Firm*—Malin, Haley & DiMaggio, P.A.

[57] ABSTRACT

A necktie knot cover and retaining device is disclosed that functions as a decorative knot cover or as a knot simulator. The invention is relatively simple and easy to manufacture, yet affords a variety of uses. The knot cover consists of a one-piece continuous body having a pair of slots for receiving portions of the necktie. The knot cover is generally shaped similar to the knot to which it is covered. The device can be used with other knots and clothing, and is not limited to neckties.

20 Claims, 4 Drawing Sheets

NECKTIE KNOT COVER AND RETAINING DEVICE

This application claims the benefit of U.S. Provisional Application No. 60/093,664, filed Jul. 22, 1998.

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention relates generally to knot covers, and more specifically, to knot covers for neckties that serve as decorative covers for neckties that are tied into a knot in the typical manner or for neckties that are not tied into a knot, the ends of said necktie simply passed through the knot cover with said cover providing the retaining function of a knot.

2. Description of Related Art

Tying a necktie typically involves the placing of a necktie around the neck of the wearer and manipulating the free ends of the necktie over the chest of the wearer into a knot, said knot formed of one free end of the necktie and positioned around the other free end of the necktie. In this manner, the necktie knot can be pulled up to the collar and neck of the wearer to assume the desired appearance. In most cases, this look involves a triangular-shaped knot of varying sizes and the necktie ends that descend therefrom, preferably comprised of the wider, top or visible necktie end, which in current fashion touches the belt portion of the trousers, and a narrower necktie end that is maintained behind the top, visible necktie end at a length less than that of said top, visible necktie end. Removing the necktie from the desired position involves pulling the knot down along one end of the necktie and removing the tie from the neck of the wearer or untying the knot so as to release the free ends.

As anyone who has attempted to tie a necktie has learned, achieving a desirable looking knot along with necktie ends of appropriate length is a time-consuming process. Neckties are provided in various lengths, widths, thicknesses, and textures, all of which combine to provide a tie with unique tying characteristics. For instance, a necktie of relatively narrow width and longer length will provide a knot of relatively small size and tie ends that are relatively equal in length. On the other hand, a necktie that possesses greater width and shorter length will provide a larger knot and shorter tie ends with the rearward necktie end configured at a significantly shorter length than that of the top necktie end so as to provide the top necktie end with the greatest possible length. This situation is complicated even further if the necktie wearer chooses to tie neckties with different knots, such as the Windsor knot. In this case, the Windsor knot requires two additional loops of the necktie so as to provide a larger knot. As a result, the hanging necktie ends are shortened by the length of necktie required for the additional loops.

Tying a necktie, therefore, is frequently a time consuming process, typically requiring that the necktie be tied and retied several times to achieve proper knot appearance and position and lengths of visible tie. Unfortunately, many wearers do not have the luxury of time and patience to engage in repeated necktie tying, as most wearers wear ties for work or special events, such as weddings, and are frequently pressed to arrive on time. Because of time constraints, a wearer reaches a compromise and settles for a necktie appearance in which the knot may not be tied in the desired shape or appearance, and the respective tie lengths may not descend from the necktie knot at the proper length and alignment. In some cases, the wearer may even leave the dwelling without tying the necktie, choosing to tie the necktie in transit or at the intended destination. Should the wearer attempt to tie the necktie while driving an automobile, the wearer may jeopardize his life and the lives of passengers, nearby drivers, and pedestrians.

Because of the frequent tying and untying of a typical necktie, the necktie material becomes worn and wrinkled in a relatively short amount of time. This condition is especially acute at the area of the necktie that is tied into a knot, said area subject to constant folding, creasing, and bending. In time, this area of a necktie may become tattered and frayed so that it may not be suitable to serve as material for a knot, as portions of the knot are visible to the wearer and viewers. In this circumstance, the wearer will be forced to tie the necktie in a typical manner, so that the knot is comprised of a different section of necktie, thus affecting the lengths and appearance of the necktie ends that descend from the knot. In some cases, it may be impossible to achieve an acceptably tied necktie under such circumstances.

What is needed then to overcome the aforementioned difficulties of tying neckties is the provision of a decorative necktie cover or similar device that resemble in appearance and dimension a knot formed after tying a typical necktie. Such a necktie cover would consist of front, back and lateral sides with a top and bottom aperture that define a cavity or channel therebetween. The necktie cover can receive and retain in releasable engagement respective necktie ends, said necktie ends entering through the upper aperture and exiting through the bottom aperture at the desired length and alignment. In another use, the necktie cover can be positioned over a necktie that is retained in place with a typical knot, said necktie cover serving a purely decorative function.

Certain designs for necktie knot covers and necktie retaining devices have been provided in the prior art. For instance, U.S. Pat. No. 5,010,593, issued to Stevens, Jr. on Apr. 30, 1991, discloses a decorative necktie knot cover that is formed to enclose a necktie knot, said cover comprised of a triangular-shaped front face panel, and two side panels, top panel, and rear panel, flexibly attached thereto. The front side and panels are folded to form a cavity receiving the necktie knot.

U.S. Pat. No. 5,035,002, issued to Knight, Jr. on Jul. 30, 1991, discloses a knot cover for ties and scarves that is designed to maintain elongated strips or loops of material such as neckties and scarves in the desired position and appearance. Said knot cover provides the means to serve as a necktie cover wherein said cover is placed over a necktie knot for decorative purposes or as a necktie knot simulator in that the knot simulator function serves to provide the appearance of a necktie knot without the necessity of the wearer's tying a necktie knot. The cover is constructed of rubber or injection molded plastic and is provided with a circular shaped body formed into an inverted truncated triangular configuration. The necktie loops or necktie knot are received within a channel or cavity defined by an upper opening and a lower opening.

The knot cover adheres to the tie or scarf by a variety of means. The rear side of the body of the knot cover is separated by a slot cut along the length of the channel so that the material of the tie or scarf can expand the channel, said channel also retracting upon the surface of the tie by virtue of the resilient nature of the cover material. Additional attachment means include an internal surface that engages frictionally with a tie or means to attach a tie tack thereto. While these means of adherence may serve to attach the cover to a tie in some circumstances, they may be ineffectual in others. If the necktie knot is relatively small or compressed, the surface of the necktie knot may not come into contact with the interior surface of the body and engage frictionally thereto, even when the cover is fully clasped. Similarly, if the necktie cover is serving as a knot simulator in that the necktie ends are simply passed through, the minimal and irregular surface area of the necktie cover can frictionally engage thereto. Even if frictional engagement is accomplished, the sometimes uneven and irregular surface characteristics of necktie knots and necktie loops may prevent the necktie knot cover from aligning thereto as desired.

As illustrated by the background art, no prior effort, has provided the benefits attendant with the present invention where a unitary device provides a decorative necktie cover and an effective means to secure necktie ends so that a retaining or knotting function is provided. As such, it may be appreciated that there is a continuing need for a new and improved necktie knot cover and retaining device. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects and advantages through a new, useful and unobvious combination of method steps and component elements, with the use of a minimum number of functioning parts, at a reasonable cost to manufacture, and by employing only readily available materials.

BRIEF SUMMARY OF THE INVENTION

The present version of the invention, which will be described in greater detail hereinafter, relates to the field of knot covers for neckties. More specifically, this version of the invention is concerned with knot covers for neckties that serve as decorative covers for neckties that are tied into a knot in the typical manner or for neckties that are not tied into a knot, the ends of said necktie simply passed through the knot cover with said cover providing the retaining function of a knot. The present invention overcomes all of the shortcomings listed previously, in addition to including novel aspects that will be described in detail hereinafter.

Described briefly, according to a typical embodiment, the invention presents a necktie knot cover and retaining device for use with common neckties, said disclosure providing a means to cover in a decorative manner the knot of a necktie or to provide the retaining feature of a knot when necktie strips are attached thereto.

In one embodiment, the device is formed with a unitary body that is generally triangular in shape. The unitary body is comprised of a front side, rear side, and lateral sides that initiate a downward slope from an upper wider end toward a narrower bottom end. Both ends are in parallel relation so that the cover device presents a truncated profile. The upper end is formed with a semi-circular aperture. Similarly the lower end is formed with an elliptical-shaped aperture. The upper end aperture is bounded on one side by lip that is attached perpendicularly to the front side and a lip portion of the rear side. Both apertures enclose a channel or cavity disposed along the vertical axis of the body of the cover. The rear side terminates at the upper end with said lip portion, which is formed with a rounded edge that terminates at some distance slightly below that of the lip of the front side. A slot is formed within each lateral side surface between the lip portion of the rear side and a portion of the upper lateral side wall.

In the preferred use of the invention as a necktie knot cover, the unattached necktie ends are inserted into the upper aperture of the cover, passed through the cavity, and pulled through the lower aperture. The knot cover is then pulled upward along the necktie until it engages and covers the necktie knot and is held in place by sliding the necktie portion that extends from the knot and around the neck of the wearer into the tie slots of the lateral side surface. When the knot cover functions as a necktie knot simulator, the procedure is similar in that the unattached ends of the necktie are passed through the upper aperture, cavity, and lower aperture of the cover, said cover then pulled upward toward the neck of the wearer until said cover engages the collar portion of the shirt or blouse and retained thereto by sliding the necktie strips into their respective tie slots. Removing the necktie knot cover from a necktie merely requires disengaging the necktie from the tie slots and sliding the cover off the necktie.

It should be understood that the invention is not limited in its application to the details of construction and to the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

Accordingly, it is an object of the invention to provide a low-cost, easy-to-manufacture, and easy-to-market necktie knot cover and retaining device.

A further object of my version of the invention is to provide an easy-to-use and versatile necktie knot cover and retaining device.

An additional object of the invention is to provide a necktie knot cover and retaining device that is able to serve as a decorative necktie knot cover for use with necktie knots and as a necktie knot simulator so as to provide the function and appearance of a necktie knot without the necessity of tying a necktie knot.

A further object of the invention is to provide a necktie knot cover and retaining device that is provided with means to securely attach and position a necktie thereto, said means consisting of slots formed within the lateral side walls of said cover and retaining device and an interior channel that frictionally engages the surface material of a necktie.

In accordance with these and other objects which will become apparent hereinafter, the instant invention will now be described with particular reference to the accompanying drawings.

BRIEF DESCRIPTION OF THE SEVERAL VIEWS OF THE DRAWINGS

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

Figure 1:
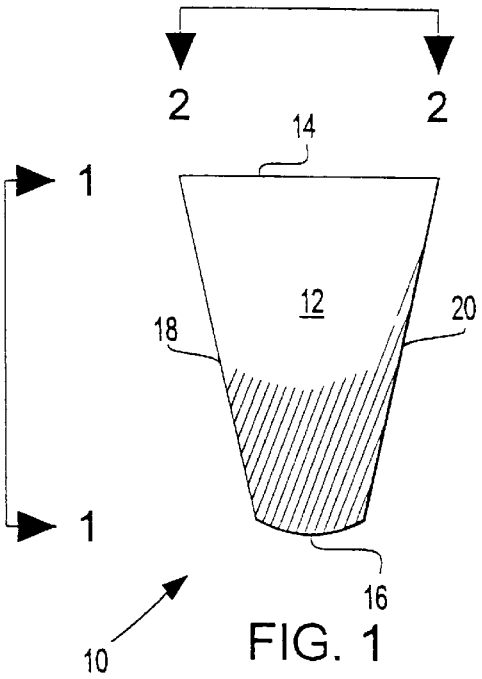
FIG. 1 is a front elevation view of a necktie knot cover and retaining device in accordance with a first embodiment of the present invention.

| Drawing Reference Numerals | |
|---|---|
| First Embodiment | |
| 10 | Necktie Knot Cover and Retaining Device |
| 12 | Front Side |
| 14 | Upper Lip of Cover |
| 16 | Lower Side |
| 18 | Lateral Side |
| 20 | Lateral Side |
| 22 | Rear Lip |
| 24 | Rear Side |
| 26 | Arcuate Lower Side Edge |
| 28a,b | Tie Slot |
| 30 | Upper Rounded Edge of Rear Tab |
| 32a, b | Lower Rounded Surface of tie Slot |
| 34 | Upper Aperture |
| 36 | Lower Aperture |
| 38 | Channel |
| 40 | Necktie |
| 42 | Wide End of Necktie |
| 44 | Narrow End of Necktie |

-continued

| Drawing Reference Numerals | |
|---|---|
| Second Embodiment | |
| 100 | Necktie Knot Cover and Retaining Device |
| 112 | Front Side |
| 114 | Upper Front Lip |
| 116 | Lower Front Lip |
| 118 | Lateral Side |
| 120 | Lateral Side |
| 121 | Rear Side |
| 122 | Rear Lip |
| 124 | Rear Member |
| 125 | Seam |
| 128a,b | Tie Slot |
| 130 | Upper Rounded Edge of Rear Lip |
| 132a,b | Lower Rounded Surface of Tie Slot |
| 134 | Upper Aperture |
| 136 | Lower Aperture |
| 138 | Channel |
| Third Embodiment | |
| 200 | Necktie Knot Cover and Retaining Device |
| 212 | Front Side |
| 214 | Upper Front Lip |
| 216 | Lower Front Lip |
| 218 | Lateral Side |
| 220 | Lateral Side |
| 221 | Rear Side |
| 222 | Rear Lip |
| 224 | Rear Member |
| 228a,b | Tie Slot |
| 230 | Upper Rounded Edge of Rear Lip |
| 232a,b | Lower Rounded Surface of Tie Slot |
| 234 | Upper Aperture |
| 236 | Lower Aperture |
| 238 | Channel |

DETAILED DESCRIPTION OF THE INVENTION

Referring now to the drawings and, in particular, to FIGS. 1 through 7, wherein there are illustrated a first embodiment of the present invention for a necktie knot cover and retaining device ("knot cover") which is generally designated as reference numeral 10. In the first embodiment, knot cover 10 consists of a generally triangular-shaped construction for use with neckties and similar articles of clothing, so as to provide in a decorative manner a cover for a knot of a necktie or to provide the retaining and clasping function of a necktie knot when the wearer of said necktie does not chose to tie a necktie knot.

Knot cover 10 is a unitary and continuous article of manufacture, consisting of a front side 12, lateral sides 18, 20 and a rear side 22, which enclose an internal cavity or channel 38. Knot cover 10, as illustrated in FIG. 1 (and FIG. 4), presents a triangular-shaped profile bounded by generally truncated upper and lower sides, i.e. an upper lip 14 and a lower side 16. The sidewalls 18, 20 are attached at their greatest distance of separation to the upper lip portion 14 and taper for some distance until they terminate at the lower side 16 of the cover. In this general configuration, the necktie cover 10 resembles the generally triangular appearance of a common necktie knot. The lower side 16 of the cover 10 is slightly rounded, presenting a partially arcuate profile, further enhancing the knot-like appearance.

Figure 2:
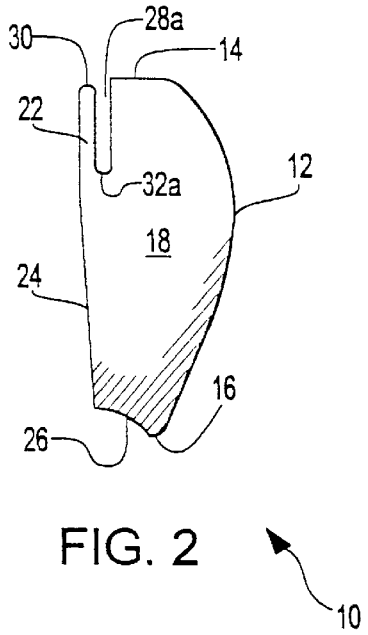
FIG. 2 is a side elevation view of the necktie knot cover and retaining device of FIG. 1, illustrating a necktie retaining slot, taken along line 1—1 of FIG. 1.

As shown in FIG. 2, the front side 12 presents a curvilinear surface wherein the front side 12 projects outward in greatest degree at its approximate medial portion, with the projection receding as the front side approaches the upper lip 14 and the lower side 16. While the projection of the front side 12 resembles the side view of a necktie, said projection also provides an interior pouch-shaped portion of the cavity or channel 38 into which portions of the necktie can be ensconced so as to aid in securing the cover 10 to the necktie.

The rear of the cover 10 is composed of a vertically disposed lip 22 that is preferably joined integrally at an angle to a flat, rear side 24 portion, said rear side 24 portion extending downward from said lip 22 toward the front side 12, so that a tapering appearance is provided for the lateral side wall 18. An arcuate, lower side edge 26, formed at the lower end of the lateral side wall 18, preferably adjoins integrally to the lower portion of the rear side 24 and the lower side 16 of the front side 12. The rear lip 22 extends vertically for some distance above the junction to the rear side 24 so that said lip 22 projects to a plane slightly below that occupied by the upper lip 14. The rear lip 22 is formed with an upper, rounded edge 30.

A tie slot 28*a* is formed within the lateral side wall 18 and can comprise a depth of approximately ½ inch, though such dimension is not limiting and other dimensions can be used and are considered within the scope of the invention. The tie slot 28*a* terminates at a rounded edge 32*a*, said edge 32*a* formed at the junction of the rear lip 22 and the lateral side wall 18.

Figure 3:
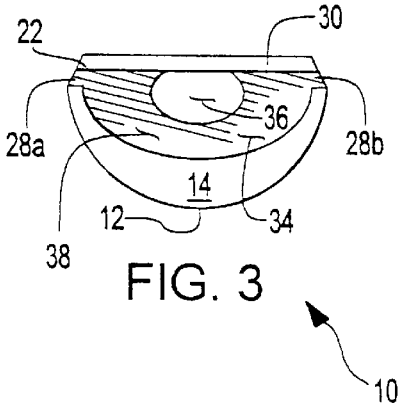
FIG. 3 is a top plan view of the necktie knot cover an retaining device taken along line 2—2 of FIG. 1 and showing the upper aperture, channel and lower aperture.
Figure 4:
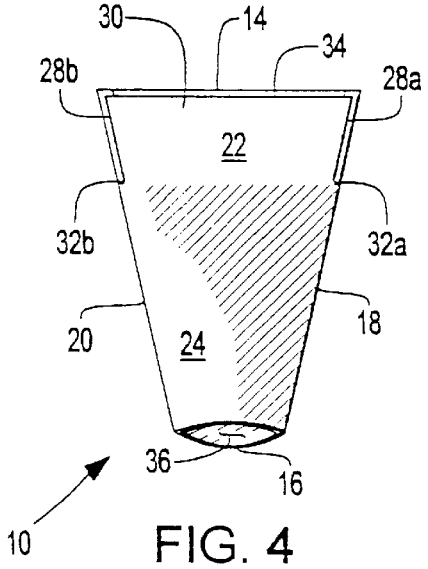
FIG. 4 is a rear elevation view of the necktie knot cover and retaining device of FIG. 1.
Figure 5:
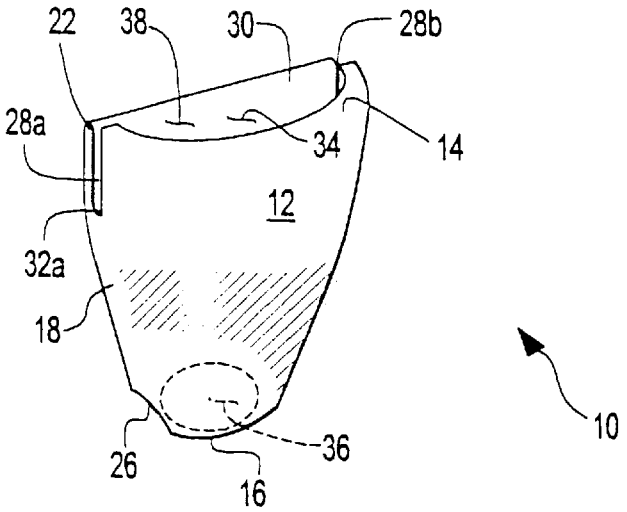
FIG. 5 is a perspective view of the necktie knot cover and retaining device of FIG. 1.

In FIG. 3, therein is illustrated an upper aperture 34 of the cover 10 and a lower aperture 36, which define a cavity or channel 38. Access to the cover 10 is gained by placing the necktie ends into the upper aperture 34, past the channel 38, and out through the lower aperture 36. The upper aperture 34 is generally shaped as a semi-circular opening, bounded on one side by the arcuate upper lip 14 and on the opposing side by the rear lip 22. The tie slots 28*a* and 28*b* separate the rear lip 22 from the front lip 14. The channel 38 tapers downward toward the lower aperture 36, which can be elliptical in shape and defines the lower extremity of the cover 10.

Figure 6:
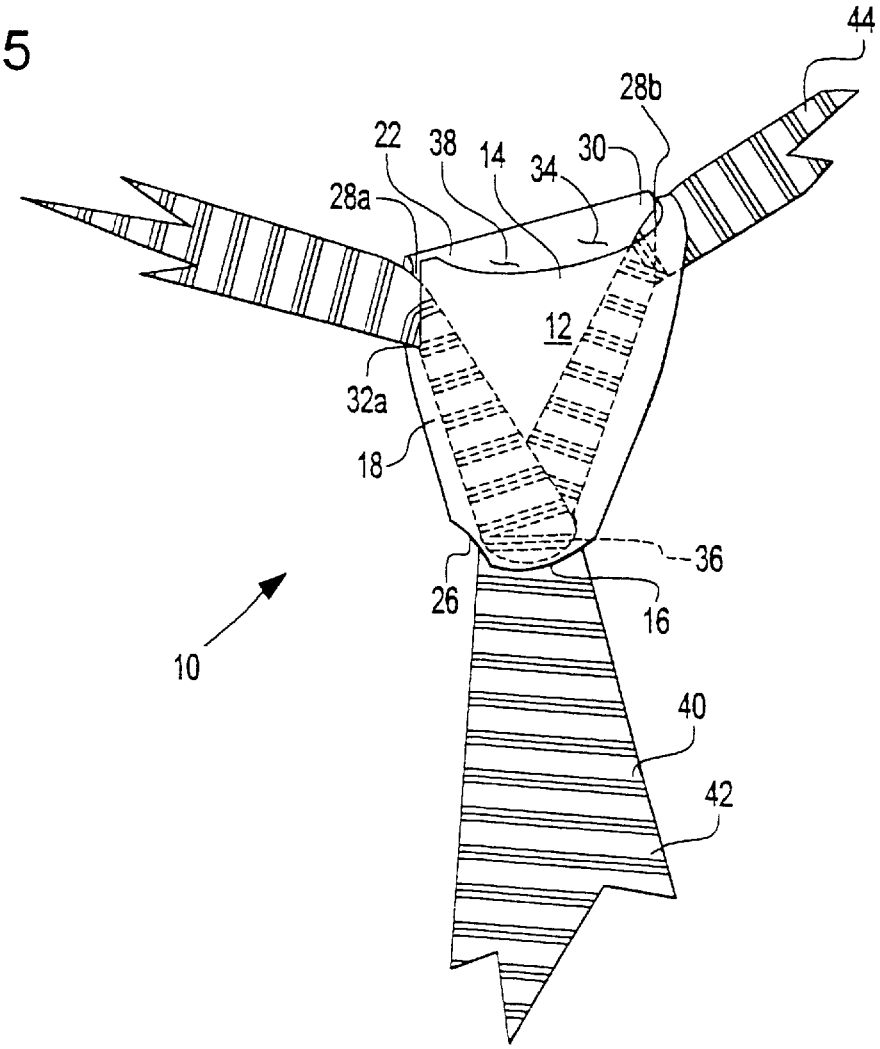
FIG. 6 is a perspective view of the necktie knot cover and retaining device of FIG. 1, showing a preferred use of the invention with a necktie passed through and retained thereto, partially shown in phantom lines.
Figure 7:
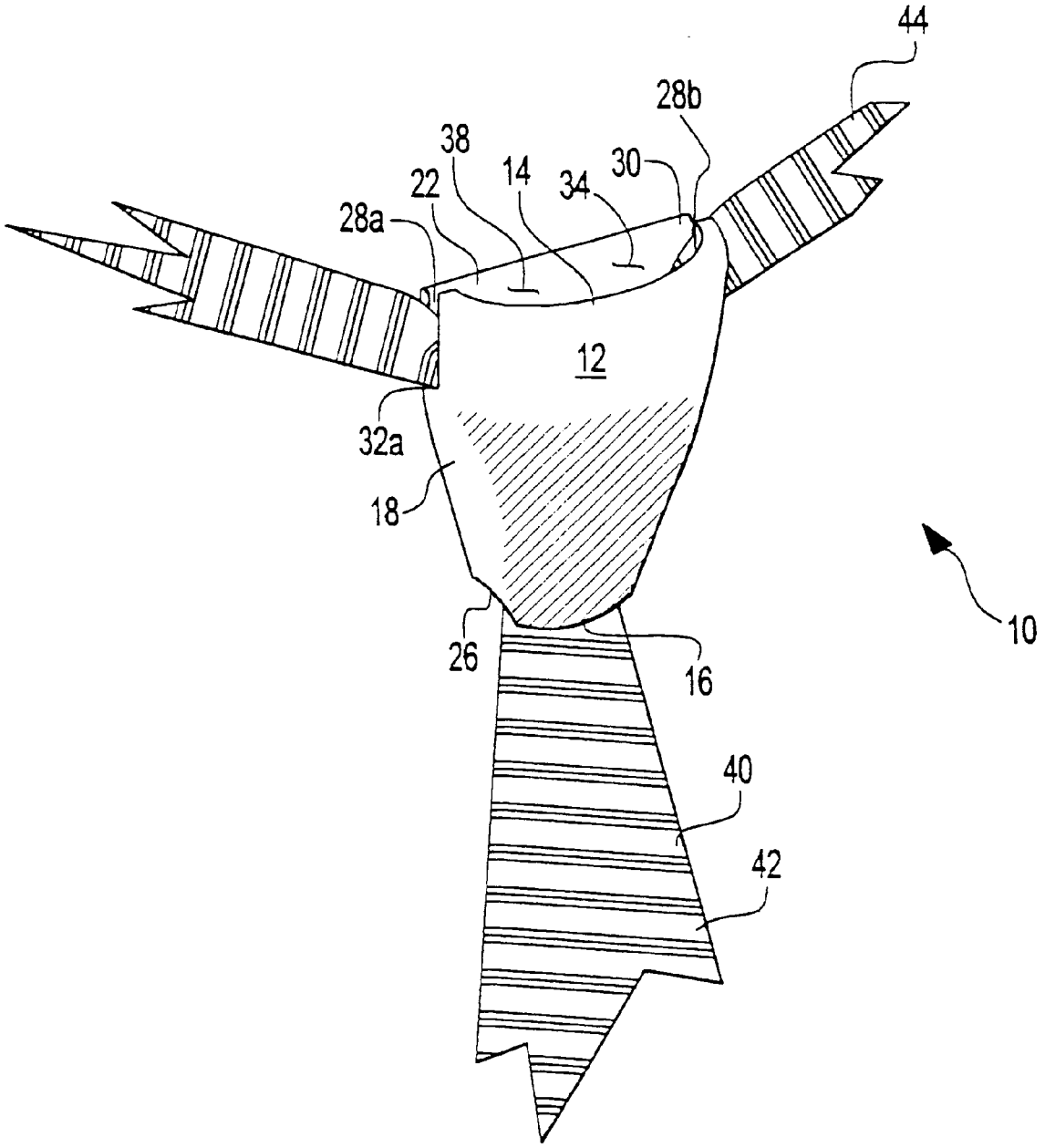
FIG. 7 is a perspective view of the necktie knot cover and retaining device of FIG. 1, illustrating a preferred appearance of the device when in use with a necktie that is provided with or without a knot.

In FIG. 6, a preferred use of the invention 10 is displayed in which a necktie 40 is inserted into the knot cover 10, said knot cover 10 providing the knot simulator or retaining function. In this use, the wearer, choosing not to tie a necktie knot but wishing to obtain the appearance of a knotted necktie, places the necktie 40 around the neck as is normally done when tying a necktie. The narrow end 44 of the necktie is initially inserted past the upper aperture 34, into the channel 38, and out through the lower aperture 36 until an acceptable length of the narrow end 44 of the necktie 40 descends from the lower aperture 36. Next, the wider end 42 of the tie 40 is passed through the upper aperture 34, channel 38, and lower aperture 36 until a length of the wider end 42 of the necktie 40 descends from the lower aperture 36 to a point somewhat longer than that of the narrow end 44, thereby covering the narrow end as is the usual case. Once the necktie ends 42, 44 are situated within the knot cover end device 10 as desired, the necktie 40 is inserted into the tie slots 28*a* and 28*b* to properly align the cover 10 under the collar of the wearer and to assist in retaining the cover 10 in position. Further assistance is provided by the friction created between the outer surface of the necktie 40 material and interior surface of the cover 10, as a portion of the tie is pressed into the channel 38 and the interior space created by the projection of the front side 12.

If the necktie cover 10 is used simply as a decorative cover in that a knot is already tied, both ends 42, 44 of the necktie 40 are simultaneously passed through the upper aperture 34, the channel 38, and out through the lower aperture 36, passage there through ceasing when the knot comes into contact with the side walls that form the lower aperture 36. The knot cover 10 is maintained in position once the necktie 40 is inserted into the tie slots 28*a* and 28*b* and adequate friction is maintained within the channel 38 between necktie surface material and the interior surface of the channel 38. The attractive and desirable appearance of the necktie cover 10 is illustrated more fully in FIG. 7, wherein the necktie cover 10 is identical in appearance whether it is functioning as a knot cover or as a knot simulator.

Figure 8:
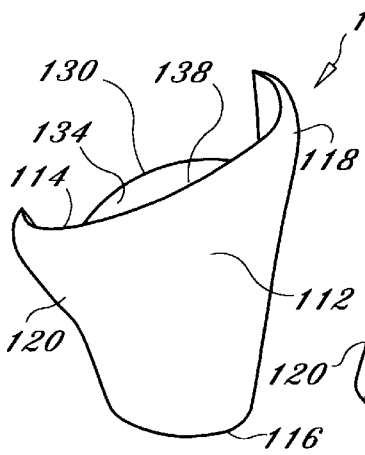
FIG. 8 is perspective view of a necktie knot cover and retaining device in accordance with a second embodiment of the present invention.
Figure 9:
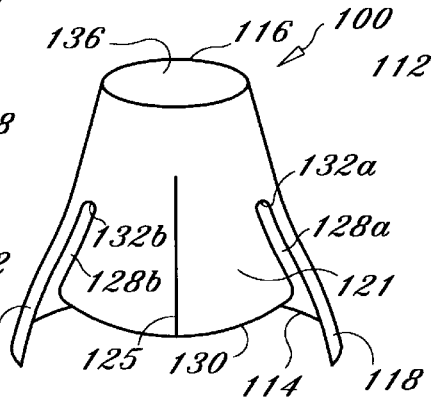
FIG. 9 is a rear upside down elevational view of the necktie knot cover and retaining device of FIG. 8, and illustrating a back seam line.
Figure 10:
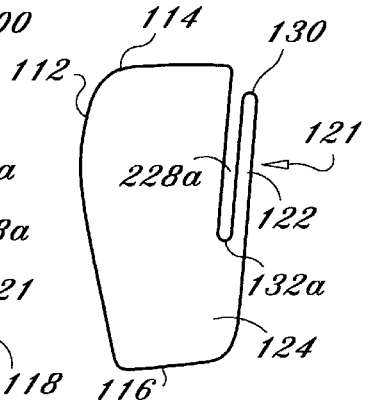
FIG. 10 is a side elevational view of the necktie knot cover and retaining device of FIG. 8.

FIGS. 8 through 10 illustrate a second embodiment of the present invention for the knot cover which is generally designated as reference numeral 100. In this embodiment, knot cover 100 consists of a generally Y-shaped construction for use with neckties and similar articles of clothing. The widening of the top of knot cover 100, as compared to the first embodiment of the invention, allows knot cover to be used with wider type knots.

Knot cover 100 is of a unitary and continuous construction, consisting of a front side 112, first and second lateral sides 118, 120 and a rear side 121, which enclose and define an internal cavity or channel 138. Knot cover 100 presents a generally Y-shaped profile bounded by an upper front lip 114 and a lower front lip 116. The sidewalls 118, 120 are made integral with upper front lip portion 114 at their greatest distance of separation and taper and curve inward for some distance until they terminate at lower lip 116. In this general configuration, the knot cover 100 resembles the generally appearance of a common necktie knots.

As shown in FIG. 10, front side 112 can present a somewhat curvilinear surface wherein the front side 112 projects outward in greatest degree at its approximate medial portion, with the projection receding as front side 112 approaches upper front lip 114 and lower front lip 116. While the projection of front side 112 preferably resembles the side view of a necktie, said projection also provides an interior pouch-shaped portion of the cavity or channel 138 into which portions of the necktie can be ensconced or disposed so as to aid in securing knot cover 100 to the necktie, such as necktie 40.

Rear side 121 of the cover 100 is composed of a substantially vertically disposed lip 122 that is joined integrally preferably at a slight angle to a preferably flat, rear side member 124. Rear side member 124 extends downward from said lip 122 toward front side 112, so that a tapering appearance is provided for the lateral side walls 118 and 120. A lower side edge 126, which can be slightly angled, is formed at the bottom of knot cover 100 and integrally and continuously adjoins to the lower portion of the rear side member 124 and the lower portion of front side 112. Rear lip 122 extends vertically, preferably at a slight angle, for some distance above its integral joining to rear side member 124 so that lip 122 projects to a horizontal plane, at its top portion, which is at least slightly below that occupied by the top portion of upper front lip 114.

Rear lip 122 is preferably formed with a rounded and curved upper edge 130. A first tie slot 128*a* is formed within the lateral side wall 118 and can be comprised of a depth of approximately ½ inch, though such dimensions is not limiting and other dimensions can be used and are considered within the scope of the invention. Tie slot 128*a* terminates at a rounded edge 132*a*. Rounded edge 132*a* is preferably formed at the integral junction of rear lip 122 and lateral side wall 118.

An upper aperture 134 of knot cover 100 and a lower aperture 136, are provided and defined at the top and bottom, respectively, of cavity or channel 138. Access to the cover 100 is gained by placing the ends of a necktie, such as necktie 40, into upper aperture 134, past channel 138, and out through lower aperture 136. The shape of upper aperture 134 is defined by front side 112, lateral side walls 118 and 120 and rear side 121 and is generally a semi-circular shaped opening. Tie slots 128*a* and 128*b* separate the rear lip 122 from the upper front lip 114, and are in communication with upper aperture 134 and channel 138. Channel 138 tapers downward toward lower aperture 136, which can be elliptical in shape and defines the lower extremity of knot cover 100. Knot cover 100 can be used similar to knot cover 10, as described above for knot cover 10.

Figure 11:
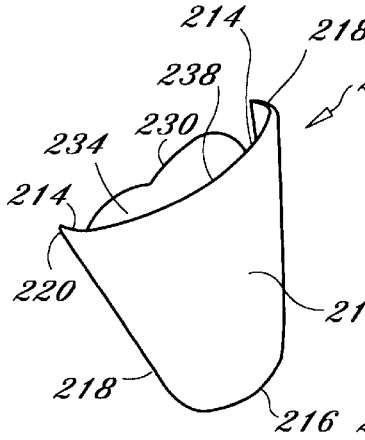
FIG. 11 is perspective view of a necktie knot cover and retaining device in accordance with a third embodiment of the present invention.
Figure 12:
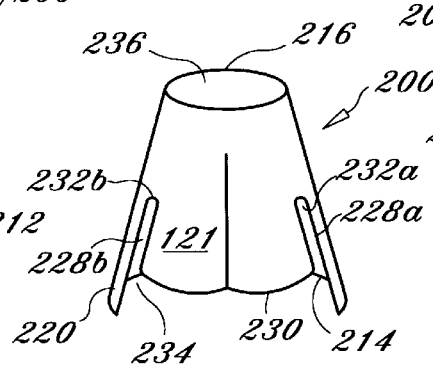
FIG. 12 is a rear upside down elevational view of the necktie knot cover and retaining device of FIG. 11, and illustrating a back seam line.
Figure 13:
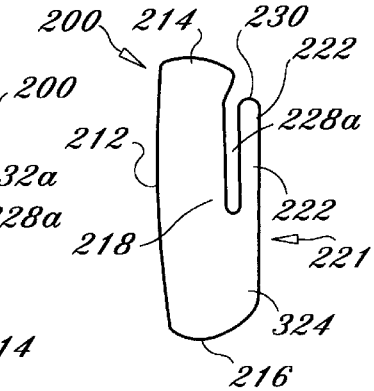
FIG. 13 is a side elevational view of the necktie knot cover and retaining device of FIG. 11.

FIGS. 11 through 13 illustrate a second embodiment of the present invention for the knot cover which is generally designated as reference numeral 100. In this embodiment, knot cover 200 consists of a generally triangular-shaped construction for use with neckties and similar articles of clothing. Knot cover 200 is of a unitary and continuous construction, consisting of a front side 212, first and second lateral sides 218, 220 and a rear side 221, which enclose and define an internal cavity or channel 238. Knot cover 200 presents a generally triangular-shaped profile bounded by an upper front lip 214 and a lower front lip 216. The sidewalls 218, 220 are made integral with upper front lip portion 214 at their greatest distance of separation and taper and curve inward for some distance until they terminate at lower lip 216. In this general configuration, the knot cover 200 resembles the generally appearance of a common necktie knots.

As shown in FIG. 13, front side 112 can present a somewhat curvilinear surface wherein the front side 212 projects outward in greatest degree at its approximate medial portion, with the projection receding as front side 212 approaches upper front lip 214 and lower front lip 216. While the projection of front side 212 preferably resembles the side view of a necktie, said projection also provides an interior pouch-shaped portion of the cavity or channel 238 into which portions of the necktie can be ensconced or disposed so as to aid in securing knot cover 200 to the necktie, such as necktie 40.

Rear side 221 of the cover 200 is composed of a substantially vertically disposed lip 222 that can be joined integrally preferably at a slight angle to a preferably flat, rear side member 224. Rear side member 224 extends downward from said lip 222 toward front side 212, so that a tapering appearance is provided for the lateral side walls 218 and 220. A lower side edge 226, which can be slightly angled, is formed at the bottom of knot cover 200 and integrally and continuously adjoins to the lower portion of the rear side member 224 and the lower portion of front side 212. Rear lip 222 extends vertically, preferably at a slight angle, for some distance above its integral joining to rear side member 224 so that lip 222 projects to a horizontal plane, at its top portion, which is at least slightly below that occupied by the top portion of upper front lip 214.

Rear lip 222 can be formed with a rounded and curved upper edge 230. A first tie slot 228*a* is formed within the lateral side wall 218 and can be comprised of a depth of approximately ½ inch, though such dimensions is not limiting and other dimensions can be used and are considered within the scope of the invention. Tie slot 228*a* terminates at a rounded edge 232*a*. Rounded edge 232*a* is preferably formed at the integral junction of rear lip 222 and lateral side wall 218.

An upper aperture 234 of knot cover 200 and a lower aperture 236, are provided and defined at the top and bottom, respectively, of cavity or channel 238. Access to the cover 200 is gained by placing the ends of a necktie, such as necktie 40, into upper aperture 234, past channel 238, and out through lower aperture 236. The shape of upper aperture 234 is defined by front side 212, lateral side walls 218 and 220 and rear side 221 and is generally a semi-circular shaped opening. Tie slots 228*a* and 228*b* separate the rear lip 222 from the upper front lip 214, and are in communication with upper aperture 234 and channel 238. Channel 238 tapers downward toward lower aperture 236, which can be elliptical in shape and defines the lower extremity of knot cover 200. Knot cover 200 can be used similar to knot cover 10, as described above for knot cover 10.

In all embodiments, it is desirable, though not limiting, that the necktie knot cover and training device is manufactured of material that is lightweight, competitive in procurement and manufacturing cost, durable, and attractive in appearance. In this respect the material of manufacture can comprise injection molded plastic or rubber, appropriate precious metals, and carved wood products, overlaid or impregnated with various finishes, such as gold, silver, ceramic, porcelain, and assorted gems.

Furthermore, in all embodiments, one or more logos, symbols, designs, patterns, wording, lettering, numbering, or other indicia (collectively referred to as "indicia") can be provided on at least a portion of the knot cover. Preferably, the indicia is provided on at least the front outer surface of the knot cover. The indicia is preferably etched or applied to the front outer surface of the knot cover. However, other methods and techniques can also be used and are also considered within the scope of the invention.

While several embodiments for the present invention has been illustrated and described in detail in the drawings and foregoing description, the same is to be considered as illustrative and not restrictive in character, and that all changes and modifications that come within the spirit of the invention are desired to be protected. With respect to the above description then, it is to be realized that the optimum dimensional relationships for the parts of the invention, to include variations in size, materials, shape, form, function and manner of operation, assembly and use, yare deemed readily apparent and obvious to the one skilled in the art, and all equivalent relationships to those illustrated in the drawings and described in the specification are intended to be encompassed by the present invention. The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A cover for at least a portion of an article of clothing, said cover comprising:

a continuous one-piece body member having a top opening and a bottom opening and defining an enclosed channel extending through said body member, said channel in communication with said top opening and said bottom opening, said body member shaped similar to a knot portion of an article of clothing; wherein a first portion of the article of clothing is received and disposed within said channel.

2. The cover of claim 1 further including at least one substantially vertical slot disposed within said body member; wherein said slot adapted to receive a second portion of the article of clothing.

3. The cover of claim 2 wherein said body member having a front side, a rear side, a first lateral side and a second lateral side.

4. The cover of claim 3 wherein said at least one slot is a first substantially vertical slot disposed at a top portion of said first lateral side and a second substantially vertical slot disposed at a top portion of said second lateral side, said first slot and said second slot in communication with said channel; wherein said first slot adapted to receive a second portion of the article of clothing and said second slot adapted to receive a third portion of the article of clothing.

5. The cover of claim 1 wherein said body member having a front side, a rear side, a first lateral side and a second lateral side.

6. The cover of claim 5 further including a substantially vertical first slot disposed at a top portion of said first lateral side and a substantially vertical second slot disposed at a top portion of said second lateral side, said first slot and said second slot in communication with said channel; wherein said first slot adapted to receive a second portion of the article of clothing and said second slot adapted to receive a third portion of the article of clothing.

7. The cover of claim 5 wherein a top portion of said rear side is generally heart shaped, wherein said body member having a vertical length and said rear side extending vertically a substantial portion of the vertical length of said body member.

8. The cover of claim 5 wherein said rear side having a curved rounded top edge, wherein said body member having a vertical length and said rear side extending vertically a substantial portion of the vertical length of said body member.

9. The cover of claim 1 wherein said body member is generally triangular in shape.

10. The cover of claim 1 wherein said body member is generally Y-shaped.

11. A cover for at least a portion of an article of clothing, said cover comprising:

a continuous one-piece body member defining a channel extending through said body member;

wherein the first portion of the article of clothing is received and disposed within said channel;

wherein said body member having a front side, a rear side, a first lateral side and a second lateral side;

wherein at least a portion of said rear side is provided with a seam.

12. A cover for at least a portion of an article of clothing, said cover comprising:

a continuous one-piece body member having a front side, a rear side, a first lateral side and a second lateral side, said body member having a top opening and a bottom opening, said front side, said rear side, said first lateral side and said second lateral side defining an enclosed channel extending through said body member, said channel in communication with the top opening and the bottom opening of said body member;

a first slot disposed at a top portion of said first lateral side, said first slot in communication with said channel;

a second slot disposed at a top portion of said second lateral side, said second slot in communication with said channel;

wherein said channel adapted to receive a first portion of an article of clothing, said first slot adapted to receive a second portion of the article of clothing and said second slot adapted to receive a third portion of the article of clothing.

13. A cover for at least a portion of an article of clothing, said cover comprising:

a continuous one-piece body member having a front side, a rear side, a first lateral side and a second lateral side, said front side, said rear side, said first lateral side and said second lateral side defining a channel extending through said body member;

a first slot disposed at a top portion of said first lateral side, said first slot in communication with said channel;

a second slot disposed at a top portion of said second lateral side, said second slot in communication with said channel;

wherein said channel adapted to receive a first portion of an article of clothing, said first slot adapted to receive a second portion of the article of clothing and said second slot adapted to receive a third portion of the article of clothing;

wherein at least a portion of said rear side is provided with a seam.

14. The cover of claim 12 wherein said body member generally triangular in shape; said first slot is disposed substantially vertical and said second slot is disposed substantially vertical.

15. The cover of claim 12 wherein said body member generally Y-shaped; said first slot is disposed substantially vertical and said second slot is disposed substantially vertical.

16. The cover of claim 12 wherein a top portion of said rear side is generally heart shaped, wherein said body member having a vertical length and said rear side extending vertically a substantial portion of the vertical length of said body member.

17. The cover of claim 12 wherein said rear side having a curved rounded top edge, wherein said body member having a vertical length and said rear side extending vertically a substantial portion of the vertical length of said body member.

18. A cover for a knot of a necktie, comprising:

a continuous one-piece body member having a front side, a rear side, a first lateral side and a second lateral side, said front side, said rear side, said first lateral side and said second lateral side defining a channel extending through said body member, at least a portion of said rear side provided with a seam, said front side, said rear side, said first lateral side and said second lateral side constructed integral with each other, said body member shaped similar to a necktie knot;

a first slot disposed at a top portion of said first lateral side, said first slot in communication with said channel;

a second slot disposed at a top portion of said second lateral side, said second slot in communication with said channel;

wherein said channel larger in diameter at a top portion of said body member than its diameter at a lower portion of said body member;

wherein a top portion of said rear side is disposed vertically lower than a top portion of said front side;

wherein a bottom portion of said rear side is disposed vertically higher than a bottom portion of said front side;

wherein said channel adapted to receive a knot of a necktie, said first slot adapted to receive another portion of the necktie and said second slot adapted to receive a further portion of the necktie.

19. The cover of claim 18 wherein the top portion of said rear side generally heart shaped.

20. The cover of claim 18 wherein said rear side having a curved rounded top edge.

* * * * *